US005692836A

United States Patent [19]

Mitchell

[11] Patent Number: 5,692,836

[45] Date of Patent: Dec. 2, 1997

[54] RECYCLING STORAGE BAG WITH DETACHABLE POCKET

[76] Inventor: Margaret I. Mitchell, P.O. Box 1684, Newberry, Fla. 32669

[21] Appl. No.: 746,573

[22] Filed: Nov. 14, 1996

[51] Int. Cl.[6] ..... B65D 30/22

[52] U.S. Cl. ..... 383/40; 383/22; 383/41; 383/43; 383/67; 383/75

[58] Field of Search ..... 383/22, 38, 40, 383/41, 43, 67, 75; 150/113; 190/110

[56] References Cited

U.S. PATENT DOCUMENTS

| | | | |
|---|---|---|---|
| 3,804,323 | 4/1974 | Bemel | 383/40 |
| 5,050,998 | 9/1991 | Wachtel | 383/67 X |
| 5,341,933 | 8/1994 | Willows | 383/41 X |
| 5,451,108 | 9/1995 | Anderson | 383/41 X |
| 5,544,745 | 8/1996 | Famorca | 383/40 X |

FOREIGN PATENT DOCUMENTS

| | | | |
|---|---|---|---|
| 13783 | 9/1898 | United Kingdom | 383/40 |
| 124300 | 3/1919 | United Kingdom | 383/41 |
| 2 268 157 | 1/1994 | United Kingdom | 383/41 |

*Primary Examiner*—Jes F. Pascua

*Attorney, Agent, or Firm*—Dorothy S. Morse; American Innovations Inc.

[57] ABSTRACT

A flexible tubular recycling container having elastic gathering means on both of its ends to reduce the size of its upper and lower openings, elongated flexible straps attached to its upper end to function as a handle or hanging support, and a removable pocket attached to its outer surface. Applications may include, but are not limited to, use in recycling both plastic bags and manufacturer's coupons.

15 Claims, 1 Drawing Sheet

RECYCLING STORAGE BAG WITH DETACHABLE POCKET

BACKGROUND—FIELD OF INVENTION

This invention relates to storage containers, specifically to a flexible tubular recycling container having a stretchable gathering means on both of its ends to reduce the size of its upper and lower openings, elongated flexible straps attached to its upper end to function as a handle or hanging support, and a removable pocket attached to its outer surface. Applications may include, but are not limited to, use in convenient storage and easy distribution of recyclable plastic bags, with a removable pocket being used for convenient storage and organized transport of manufacturer's coupons to a store for redemption.

BACKGROUND—DESCRIPTION OF PRIOR ART

Recycling is practiced and encouraged in most households. In many households clean, intact plastic bags are saved for future use, however, they are usually stored in a non-compact and disorganized manner, such as being stuffed into a cabinet or a drawer, tossed under a sink, or placed into some other hidden location. This type of storage takes up storage space that could be better devoted to some other use. It also makes accessing one or more plastic bags inconvenient since it involves separating and sorting through the loosely stored plastic bags to find the correct size of plastic bag required for a needed use, then recompacting the remaining plastic bags so that they again will fit into the space allotted for their storage. The present invention allows recyclable plastic bags to be stored and dispensed one at a time for the ease and convenience of a user, while at the same time providing an eye-appealing and decor-enhancing storage container.

Occasionally, more plastic bags are acquired by a household than can be conveniently recycled therein. Although many communities offer curbside recycling, such service usually does not extend to plastic bags. Also, while grocery stores commonly accept plastic bags for recycling, since the recycling need is only occasional, it is often difficult for shoppers to remember to take plastic bags with them on a grocery store trip for recycling. Excess plastic bags are many times discarded when they accumulate to the point of becoming a nuisance, resulting in the wasting of a recyclable resource. Therefore, since shoppers usually remember take manufacturer's coupons with them to a store for redemption, it would be useful, and it is not known, to have a recycling bag which would combine the storage of plastic bags with the storage of manufacturer's coupons, so that shoppers are reminded to recycle plastic bags at the same time they collect their manufacturer's coupons immediate to a shopping trip. In between shopping trips, the recycling bag would provide a convenient means of storing and dispensing plastic bags for household use. The detachable pocket of the present invention provides a convenient storage place for manufacturer's coupons which would also help shoppers who set aside manufacturer's coupons for later use and forget where they place them. When made from decorative, washable material, the present invention would provide a convenient decor-enhancing means of storing approximately fifty to one hundred used plastic bags. Also, when there are not enough plastic bags yet stored therein to make it worth the time of the shopper to carry the entire recycling bag to the grocery store, the shopper could easily remove the detachable coupon pocket from the recycling bag and have a convenient carrying container for the manufacturer's coupons readily available to the shopper for use.

Many types of fabric storage containers are known. U.S. Pat. No. 2,020,556 to Kirkpatrick (1935) discloses a protective device for knitting which is cylindrical in configuration with an upper drawstring threaded through holes near its upper edge. The present invention is distinguished from the Kirkpatrick invention in that the present invention has a lower dispensing opening, as well as upper and lower openings which are permanently gathered by a stretchable material, such as elastic. Similarly, U.S. Pat. No. 1,572,605 to Howe (1923) discloses a laundry bag with a gatherable upper opening. Further a tubular shaped fabric device is disclosed in U.S. Pat. No. 4,055,201 to Fowler (1977) for slipping over an expandable member for the dispensing liquids. The present invention is distinguished from the Howe invention in that the present invention has a larger lower dispensing opening which is gathered with elastic material. Also, U.S. Pat. No. 4,221,250 to Manerba (1980) and U.S. Pat. No. 4,991,979 to Strand (1991) disclose fabric containers having non-gathered upper and lower openings. The Manerba invention discloses a six-sided bag made from two rectangular flaps, each providing a base wall and two side walls. Prior to joining with one continuous seam or weld, the two flaps are positioned relative to one another so that each base wall is opposed to the other base wall, and the side walls provided by one flap are rotated ninety degrees relative to the second flap. The Strand invention provides a container with an upper lifting loop and a bottom with two parts so as to provide means for selectively closing its lower opening.

The prior art most closely related to the present invention is the invention disclosed in U.S. Pat. No. 5,341,933 to Willows (1994). The Willows invention discloses a tubular storage and dispensing device for storing plastic bags which has an elastic band sewn in a hem around the lower dispensing opening and a drawstring around its upper entry opening. The present invention can be distinguished from the Willows invention. Although both are tubular and have upper and lower openings, the present invention has elastic bands sewn in both ends for faster easier in insertion of plastic bags. Instead of having to unfasten a drawstring, and refasten it, each time plastic bags are added to the Willows bag, plastic bags can be easily inserted into the present invention without this extra step. If recycling is not made convenient and easy, many people will not participate. Therefore, the easier the access to a recycling container is made, the more likely it will be for people to use it. Also, it is contemplated for the present invention to be smaller than the Willow invention which is 60 centimeters long, thirty centimeters wide, and has a lower opening which when contracted is approximately two-and-one-half centimeters and which expands to a diameter of approximately eight centimeters. In contrast, it is contemplated for the maximum length of the present invention to be approximately eighteen inches, or forty-six centimeters, the maximum width of the present invention to be approximately eight-and-one-half inches, or twenty-two centimeters, for its lower opening when contracted to be approximately four centimeters, expanding to a diameter of approximately eight centimeters. Thus it is contemplated for the present invention to be more compact for easier out-in-the-open storage for increased convenience of a user. Further, the present invention has a coupon pocket removably detachable from the main body of the recycling bag, so that the present invention can help a user to conveniently collect both plastic bags and coupons between visits to a grocery store where both are recyclable to the benefit of the user. It is not known to have a flexible tubular recycling container stretchably gathered on both of its ends, with elongated flexible straps attached to its upper end to function as a handle or hanging support, and with a removable pocket attached to its outer surface dimensioned for the storage of manufacturer's coupons.

SUMMARY OF INVENTION—OBJECTS AND ADVANTAGES

It is the primary object of this invention to provide a recycling bag which can be used to store and dispense plastic bags for household use, as well as transport plastic bags to a remote location for bulk recycling. A further object of this invention is to provide a recycling bag which also has means for convenient and easily accessible storage of manufacturer's coupons. It is also an object of this invention to provide a recycling bag which is made from easily washable materials. A further object of this invention is to provide a recycling bag which will conveniently hold a maximum of approximately one hundred plastic bags. It is also an object of this invention to provide a recycling bag made from decorative fabrics which will allow out-in-the-open storage of plastic bags for convenience of a recycler.

As described herein, properly manufactured and used, the present invention would provide a compact, decorative means of accumulating plastic bags for household use, as well as for transporting them to a recycling center, such as a grocery store, for bulk recycling. Its detachable outside pocket would be configured to hold typical sizes of manufacturer's coupons. By storing both plastic bags and manufacturer's coupons together, a user will be prompted to benefit from the recycling of both. Elongated straps attached to one end of the recycling bag could be used to suspend the recycling bag during storage, and be used alternately as a handle to carry the recycling bag to a recycling center or grocery store. In the preferred embodiment it is contemplated for the recycling bag to be cylindrical in shape, with both ends gathered by elastic means. Also, when a plastic bag is needed for household use after it has been inserted into the present invention, it can easily be removed through the lower opening of the present invention, the size of its lower opening allowing the plastic bags to be easily dispensed one at a time.

The description herein provides preferred embodiments of the present invention but should not be construed as limiting the scope of the recycling bag invention. For example, variations in the type of material used to make the recycling bag, the length and maximum width dimensions of the recycling bag, the size of the pocket, the positioning of the detachable means used to connect the coupon pocket to the outside of the recycling bag fabric, and the length and width of the elongated straps, other than those shown and described herein, may be incorporated into the present invention. Thus the scope of the present invention should be determined by the appended claims and their legal equivalents, rather than the examples given.

DETAILED DESCRIPTION OF PREFERRED EMBODIMENTS

Figure 1:
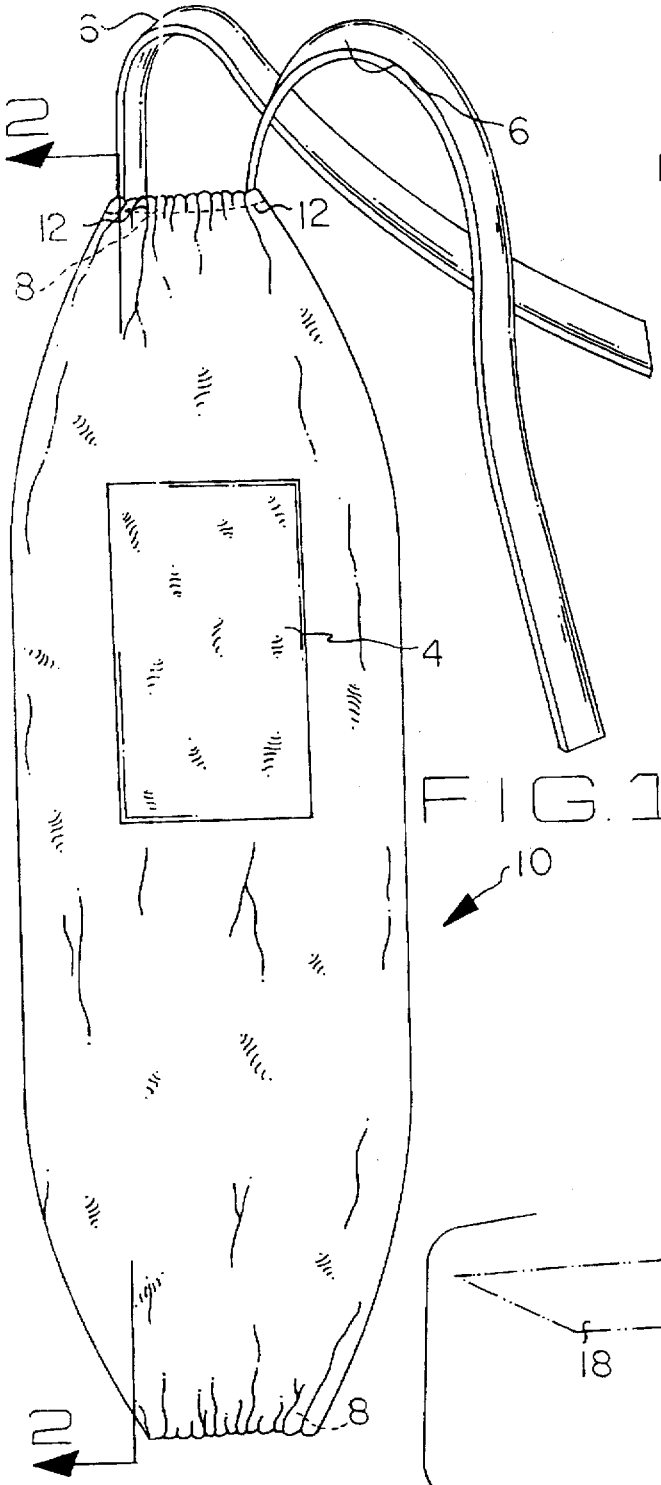
FIG. 1 is a from view of the invention.

FIG. 1 shows a preferred embodiment of a recycling bag invention 10 having a tubular bag member 2 with upper and lower openings and being expanded through the storing therein of plastic bags (not shown). Two elongated straps 6 are each attached on one of its ends to bag member 2 adjacent to its upper opening and on opposite sides thereof. FIG. 1 also shows the upper and lower ends of bag member 2 being gathered and reduced in size to a dimension smaller than its center portion through stitching 12 which retains a stretchable member 8 within a hem formed in each end of bag member 2. In the preferred embodiment it is contemplated for stretchable member 8 to comprise elastic. In addition, FIG. 1 shows a pocket 4 attached to one part of the outside surface of bag member 2. It is contemplated for pocket 4 to be dimensioned to hold typically sized manufacturer's coupons 18. Although not shown, it is also contemplated for more than one pocket 4 to be attached to bag member 2.

Figure 2:
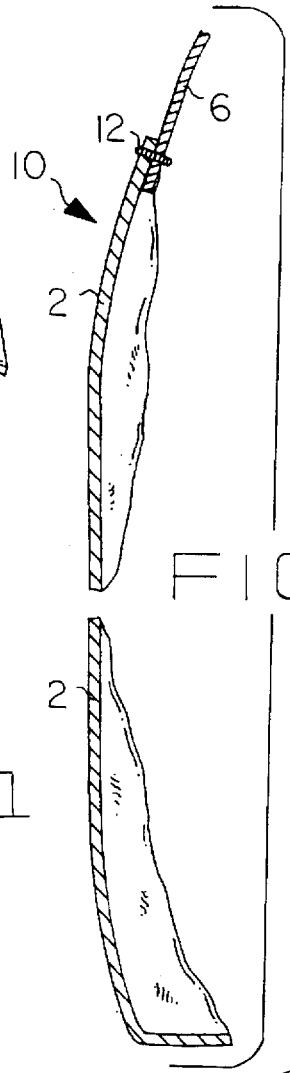
FIG. 2 is a side view of the bag portion of the invention in a collapsed state.

FIG. 2 shows recycling bag invention 10 empty and in a collapsed state. FIG. 2 shows bag member 2 having stitching 12 at both its upper and lower ends, stitching 12 being used to bind each stretchable member 8 within folded-over portions of the material comprising bag member 2 that each forms a hem. FIG. 2 also shows one strap 6 attached to bag member 2 adjacent to its upper opening.

Figure 3:
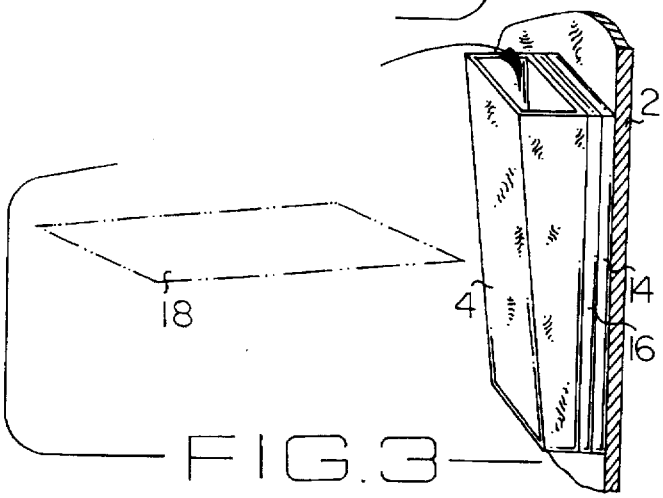
FIG. 3 is a side view of the detachable pocket of the invention.

FIG. 3 shows pocket 4 being attached to the outside surface of bag member 2 with fasteners comprising a hook portion 16 and a pile portion 14. In the preferred embodiment, the type of fastener used is not critical to the present invention as long as the fasteners used make pocket 4 easily releasable from bag member 2. FIG. 3 shows pile portion 14 attached to bag member 2 and hook portion 16 attached to the back of pocket 4. Pocket 4 has a top opening and is dimensioned for insertion therein of typically sized manufacturer's coupons 18. Although FIG. 3 shows pile portion 14 attached to bag member 2 and hook portion 16 attached to the back of pocket 4, it is also contemplated for hook portion 16 attached to bag member 2 and pile portion 14 attached to the back of pocket 4.

In the preferred embodiment it is contemplated for bag member 2 to be made from a piece of washable, breathable fabric, such as cotton, that is approximately eighteen inches square. The fabric should be able to allow air to flow therethrough to prevent mold that could develop in moisture sometimes retained by plastic bags used to carry cold food products. Fabric having decorative colors and patterns thereon would allow recycling bag invention 10 to be placed in an out-in-the-open place for the convenience of its user. Two opposite sides of the square would be stitched with an approximately one-half inch seam to form the tubular shape of bag member 2. Opposite ends of the tubular bag member 2 would be folded under to form a hem, with one stretchable member 8 fastened within each hem by stitching 12 to gather and thereby reduce the upper opening to a diameter of approximately two inches, expandable to approximately four inches, and to collapse the lower opening to a diameter of approximately one-and-one-half inches, expandable to approximately three inches. In the preferred embodiment, stitching 12 is positioned approximately one-half inch from each opening in bag member 2. Each strap 6 is made from a piece of fabric approximately eighteen inches in length by approximately three inches in width, with seams which are approximately one-half inch in width. In the preferred embodiment it is contemplated for one end of each strap 6 to be stitched to bag member 2 on opposite sides of its upper opening. Also, in the preferred embodiment pocket 4 is made to have an upper opening, a front, a back, and be removably attached to bag member 2. In the preferred embodiment, pocket 4 is four inches in width and six-and-one-half inches in length, and placed approximately four inches from the upper opening of bag member 2 and approximately seven-and-one-half inches above the lower opening of bag member 2. Also in the preferred embodiment the top opening in pocket 4 is positioned along one of the four inch wide edges of pocket 4. Further in the preferred embodiment two hook portions 16, each being approximately three inches in length and five-eighths of an inch in width, are attached to bag member 2 approximately four-and-one-half inches below the upper opening in bag member 2, and approximately eight inches above the lower opening of bag member 2. Two pile members 14, each being approximately three inches in length and five-eighths of an inch in width, are attached to the back of pocket 4 approximately one-half inch from its upper and lower edges for releasable connection of pocket 4 to the two hook members 16. Not critical to recycling bag invention 10 is type of material used to make bag member 2, as long as the material is breathable, the actual length and maximum width dimensions of recycling bag invention 2, however it should provide compact storage of recycled plastic bags and be no greater than eighteen inches in length, the size and number of pockets 4 attached to bag member 2 although each pocket 4 must be sufficiently large to hold typically sized manufacturer's coupons, the positioning of hook portions 16 and pile portions 14 as long as they securely hold pockets 4 to bag member 2, and the length and width of straps 6 as long as they are convenient for use in suspended storage of bag member 2.

To use recycling bag invention 10, one would tie or suspend bag member 2 from a nail or hook (not shown) in a location for near-at-hand, convenient use. As a shopper finds manufacturer's coupons 18 for redemption during an upcoming shopping trip, the shopper would place them in pocket 4 for safekeeping and easy access. As plastic bags (not shown) are accumulated by the shopper, the plastic bags would be placed into bag member 2 through it upper opening. Should the shopper need to retrieve one of the plastic bags for household use, it may be removed through the lower opening in bag member 2. The stretchably gathered upper and lower openings in bag member 2 prevent plastic bags stored therein from being inadvertently removed therefrom. Also, stretchable member 8 makes plastic bags easily inserted into and removed from bag member 2 without having to unfasten a drawstring or other type of closure for access to the interior of bag member 2. When the shopper plans a trip to a grocery store, both plastic bags requiring bulk recycling and manufacturer's coupons are already compactly assembled for the shopper, who then simply removes straps 6 from the nail or hook to which they are attached and carries them in recycling bag invention 10 to the store. Should there be an inadequate number of plastic bags stored within recycling bag invention 10 to make it worthwhile for the shopper to carry bag member 2 to the store, the shopper can conveniently remove pocket 4 from bag member 2 and instead only carry pocket 4 to the store for redemption of the manufacturers coupons stored therein.

What is claimed is:

1. A recycling bag for the storage dispensing of plastic bags and manufacturer's coupons, said recycling bag comprising a tubular bag member having an upper opening, a lower opening, and an outside surface, said bag member being made from breathable fabric so as to prevent the growth of mold therein from moisture which can be present on said plastic bags after prior uses; two stretchable members, said upper opening and said lower opening each being reduced in dimension by one of said stretchable members; two elongated straps, each of said straps being attached to said bag member adjacent to said upper opening; at least one pocket having a back and a top opening, said pocket being dimensioned to hold a plurality of typically sized manufacturer's coupons; and at least two lengths of hook material and at least two identical lengths of pile material for connection between said back of said pocket and said outside surface of said bag member so as to provide a shopper compact storage of both plastic bags within said bag member and manufacturer's coupons within said pocket for convenience in recycling both said manufacturer's coupons and one-at-a-time household recycling of said plastic bags, as well as bulk recycling of said plastic bags in a location remote to said household.

2. The recycling bag of claim 1 wherein said upper opening and said lower opening each comprise a hem and wherein said stretchable members are positioned within said hems.

3. The recycling bag of claim 1 wherein said stretchable members comprise elastic.

4. The recycling bag of claim 1 wherein said breathable fabric comprises cotton.

5. The recycling bag of claim 1 wherein said breathable fabric used to make said bag member is approximately eighteen inches square and is stitched with seams which have a minimum approximate width of one-half of an inch.

6. The recycling bag of claim 5 wherein said straps are approximately eighteen inches in length.

7. The recycling bag of claim 6 wherein each of said pockets are approximately four inches in width and approximately six-and-one-half inches in length.

8. The recycling bag of claim 7 wherein each of said lengths of pile material and said lengths of hook material are approximately five-eighths of an inch in width and approximately three inches in length.

9. A recycling bag for the storage dispensing of plastic bags and manufacturer's coupons, said recycling bag comprising a tubular bag member having an upper opening, a lower opening, and an outside surface, said bag member being made from breathable fabric so as to prevent the growth of mold therein from moisture which can be present on said plastic bags after prior uses, said upper opening and said lower opening each comprising a hem; two stretchable members, one of said stretchable members being positioned within each of said hems so that said stretchable members reduce in dimension said upper opening and said lower opening; two elongated straps, each of said straps being attached to said bag member adjacent to said upper opening; at least one pocket having a back and a top opening said pocket being dimensioned to hold a plurality of typically sized manufacturer's coupons; and at least two lengths of hook material and at least two identical lengths of pile material for connection between said back of said pocket and said outside surface of said bag member so as to provide a shopper compact storage of both plastic bags within said bag member and manufacturer's coupons within said pocket for convenience in recycling both said manufacturer's coupons and one-at-a-time household recycling of said plastic bags, as well as bulk recycling of said plastic bags in a location remote to said household.

10. The recycling bag of claim 9 wherein said breathable fabric used to make said bag member is approximately eighteen inches square and is stitched with seams which have a minimum width of approximately one-half of an inch, said straps are approximately eighteen inches in length, each of said pockets are approximately four inches in width and approximately six-and-one-half inches in length, and each of said lengths of pile material and each of said lengths of hook material are approximately five-eighths of an inch in width and approximately three inches in length.

11. The recycling bag of claim 10 wherein said stretchable members comprise elastic.

12. The recycling bag of claim 10 wherein said breathable fabric comprises cotton.

13. An improved recycling bag for storage of plastic bags which comprises a tubular bag member having an upper opening, a lower opening, an outside surface, and means for suspending said recycling bag during use, wherein the improvements comprise a compact dimension having a maximum length of approximately eighteen inches; at least one coupon pocket being releasably attached to said outside surface of said tubular member so that said recycling bag can store both plastic bags and manufacturer's coupons for recycling; releasable attachment means for attaching said coupon pockets to said outside surface of said bag member; and said upper opening and said lower opening each having a hem with one stretchable member positioned within each hem so as to reduce said upper opening to a diameter of approximately two inches, expandable to approximately four inches, and reduce said lower opening to approximately one-and-one-half inches, expandable to approximately three inches, so as to provide a recycling bag which has a more conveniently accessible interior for storage of plastic bags for both household recycling and bulk recycling at locations remote from a household.

14. The improved recycling bag of claim 13, wherein said bag member comprises cotton fabric and said stretchable members comprise elastic.

15. The improved recycling bag of claim 14 wherein said cotton fabric is approximately eighteen inches square and is stitched with seams having a minimum width of approximately one-half of an inch, each of said coupon pockets are approximately four inches in width and approximately six-and-one-half inches in length, and said releasable attachment means comprises lengths of pile material and lengths of hook material which are each approximately five-eighths of an inch in width and approximately three inches in length.

* * * * *